US009837719B2

(12) United States Patent
Kim et al.

(10) Patent No.: US 9,837,719 B2
(45) Date of Patent: Dec. 5, 2017

(54) PATCH ANTENNA

(71) Applicant: ELECTRONICS AND TELECOMMUNICATIONS RESEARCH INSTITUTE, Daejeon (KR)

(72) Inventors: Dong-Young Kim, Daejeon (KR); Dong Min Kang, Daejeon (KR); Seong-Il Kim, Daejeon (KR); Hae Cheon Kim, Daejeon (KR); Jae Won Do, Daejeon (KR); Byoung-Gue Min, Sejong-si (KR); Ho Kyun Ahn, Daejeon (KR); Hyung Sup Yoon, Daejeon (KR); Sang-Heung Lee, Daejeon (KR); Jong Min Lee, Daejeon (KR); Jong-Won Lim, Daejeon (KR); Yoo Jin Jang, Daejeon (KR); Hyun Wook Jung, Daejeon (KR); Kyu Jun Cho, Daejeon (KR); Chull Won Ju, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 15/229,891

(22) Filed: Aug. 5, 2016

(65) Prior Publication Data

US 2017/0237171 A1 Aug. 17, 2017

(30) Foreign Application Priority Data

Feb. 12, 2016 (KR) ..... 10-2016-0016412

(51) Int. Cl.
*H01Q 9/04* (2006.01)
*H01Q 1/50* (2006.01)

(52) U.S. Cl.
CPC ..... *H01Q 9/0407* (2013.01); *H01Q 1/50* (2013.01)

(58) Field of Classification Search
CPC ..... H01Q 9/0407; H01Q 9/04; H01Q 1/50
See application file for complete search history.

(56) References Cited

U.S. PATENT DOCUMENTS 8,319,689 B2 11/2012 Kim et al.
8,749,434 B2 6/2014 Han et al.
(Continued)

FOREIGN PATENT DOCUMENTS

KR 10-2011-0114373 A 10/2011
KR 10-1256556 B1 4/2013

*Primary Examiner* — Hoang Nguyen
(74) *Attorney, Agent, or Firm* — Rabin & Berdo, P.C.

(57) ABSTRACT

Provided herein is a patch antenna including a multilayered substrate on which a plurality of dielectric layers are laminated; at least one metal pattern layer disposed between the plurality of dielectric layers outside a central area of the multilayered substrate; an antenna patch disposed on an upper surface of the multilayered substrate and within the central area; a ground layer disposed on a lower surface of the multilayered substrate; a plurality of connection via patterns penetrating the plurality of dielectric layers to connect the metal pattern layer and the ground layer, and surrounding the central area; a transmission line comprising a first transmission line unit disposed on the upper surface of the multilayered substrate and located outside the central area, and a second transmission line unit disposed on the upper surface of the multilayered substrate and located within the central area; and an impedance transformer located below the second transmission line unit within the central area of the multilayered substrate.

14 Claims, 5 Drawing Sheets

(56) References Cited

U.S. PATENT DOCUMENTS

| | | | | |
|---|---|---|---|---|
| 2006/0256016 | A1 | 11/2006 | Wu et al. | |
| 2012/0092219 | A1* | 4/2012 | Kim | H01Q 1/38 343/700 MS |
| 2012/0287008 | A1 | 11/2012 | Kim | |
| 2013/0088396 | A1* | 4/2013 | Han | H01Q 9/04 343/700 MS |
| 2015/0207233 | A1 | 7/2015 | Kim et al. | |

* cited by examiner

PATCH ANTENNA

CROSS-REFERENCE TO RELATED APPLICATIONS

The present application claims priority to Korean patent application number 10-2016-0016412 filed on Feb. 12, 2016, the entire disclosure of which is herein incorporated by reference in its entirety.

BACKGROUND

1. Field

The following description relates to a patch antenna, and more particularly, to a patch antenna that has broadband characteristics in the 60 GHz band and in the millimeter wave band, and also high-gain characteristics of good radiation efficiency.

2. Description of Related Art

The frequency of the millimeter wave band has more straightforward and also has broadband characteristics as compared with those of microwave band, thereby being attracted in applications of radar and communication services, etc. Especially, since the millimeter wave band has a small wavelength, it is easy to miniaturize the size of an antenna when using the millimeter wave band, and thus it has an advantage of significantly reducing the system size. Communication services using such a millimeter wave band, for example, broadband communication services using the 60 GHz band and automotive radar services using the 77 GHz band are already in their advanced stages in commercialization, and related products are being released.

SUMMARY

A purpose of the present disclosure is to provide a high-gain patch antenna having broadband characteristics and high radiation efficiency in the millimeter wave band.

Furthermore, another purpose of the present disclosure is to provide a patch antenna with expanded bandwidth by inserting an impedance transformer mounted thereon to alleviate rapid changes in the impedance occurring in a feeding transmission line.

Furthermore, another purpose of the present disclosure is to expand the bandwidth of the antenna, and thereby provide a patch antenna having a bandwidth of 9 GHz or more at the 60 GHz band based on the expanded bandwidth.

It will be understood that the technical tasks of the embodiments of the present disclosure are not limited to the aforementioned, but may include various technical tasks within the scope obvious to one skilled in the related art. Other features and aspects may be apparent from the following detailed description, the drawings, and the claims.

In one general aspect, there is provided a patch antenna including a multilayered substrate on which a plurality of dielectric layers are laminated; at least one metal pattern layer disposed between the plurality of dielectric layers outside a central area of the multilayered substrate; an antenna patch disposed on an upper surface of the multilayered substrate and within the central area; a ground layer disposed on a lower surface of the multilayered substrate; a plurality of connection via patterns penetrating the plurality of dielectric layers to connect the metal pattern layer and the ground layer, and surrounding the central area; a transmission line comprising a first transmission line unit disposed on the upper surface of the multilayered substrate and located outside the central area, and a second transmission line unit disposed on the upper surface of the multilayered substrate and located within the central area; and an impedance transformer located below the second transmission line unit within the central area of the multilayered substrate.

Furthermore, the impedance transformer may be located below the second transmission line unit within a second area expanded inwardly by as much as a second predetermined length from a boundary line of the central area.

Furthermore, the impedance transformer may include at least one impedance transformation pattern that has a lower height than the connection via patterns, and that extends from the ground layer towards the upper surface of the multilayered substrate.

Furthermore, the impedance transformation pattern may extend up to a middle layer of the plurality of dielectric layers laminated on the multilayered substrate.

Furthermore, the at least one metal pattern layer may extend up to the impedance transformation pattern.

Furthermore, the first transmission line unit and the second transmission line unit may be connected in a trapezoidal form.

Furthermore, within a first area expanded outwardly by as much as a first predetermined length from a boundary line of the central area, a width of the first transmission line unit may decrease as it becomes closer to the boundary line of the central area, and within a second area expanded inwardly by as much as a second predetermined length from the boundary line of the central area, a width of the second transmission line unit may increase as it becomes closer to the boundary line of the central area.

Furthermore, the first length and the second length may be identical to each other.

Furthermore, the width of the first transmission line unit outside the first area may be 140 um, the width of the second transmission line unit outside the second area may be 80 um, and each of the first length and the second length may be 500 um to 550 um.

Furthermore, the width of the first transmission line unit outside the first area may be 140 um, the width of the second transmission line unit outside the second area may be 80 um, and each of the first length and the second length may be 540 um.

The width of the first transmission line unit and the width of the second transmission line unit may be different from each other.

Furthermore, the plurality of connection via patterns may be spaced apart from each other by or less than a half a wavelength being radiated from the antenna patch.

Furthermore, a shape of the antenna patch may be at least one of a ring shape, a circular shape, an octagonal shape, a trapezoidal shape, a square shape, and a triangular shape.

Furthermore, a shape of the central area may be at least one of a circular shape, an octagonal shape, and a square shape.

According to an embodiment of the present disclosure, it is possible to provide a high-gain patch antenna with broad bandwidth and high radiation efficiency in the millimeter wave band.

Furthermore, according to an embodiment of the present disclosure, it is possible to expand the bandwidth of an antenna by introducing an impedance transformer mounted thereon to alleviate rapid changes in the impedance occurring in a transmission line.

Furthermore, according to an embodiment of the present disclosure, it is possible to expand the bandwidth of the antenna, and thereby provide a patch antenna with a bandwidth of 9 GHz or more at the 60 GHz band.

Furthermore, according to an embodiment of the present disclosure, as the patch antenna includes an impedance transformer, it is possible to reduce the reflection loss caused by rapid changes in the impedance along the feeding transmission line, thereby expanding the bandwidth of the patch antenna, and especially thanks to the impedance transformer included in the patch antenna, expand the bandwidth of the antenna from about 7.3 GHz to about 12 GHz.

It will be understood that effects of the embodiments of the present disclosure are not limited to the aforementioned, but may include various effects within the scope obvious to one skilled in the related art. Other features and aspects may be apparent from the following detailed description, the drawings, and the claims.

Figure 1:
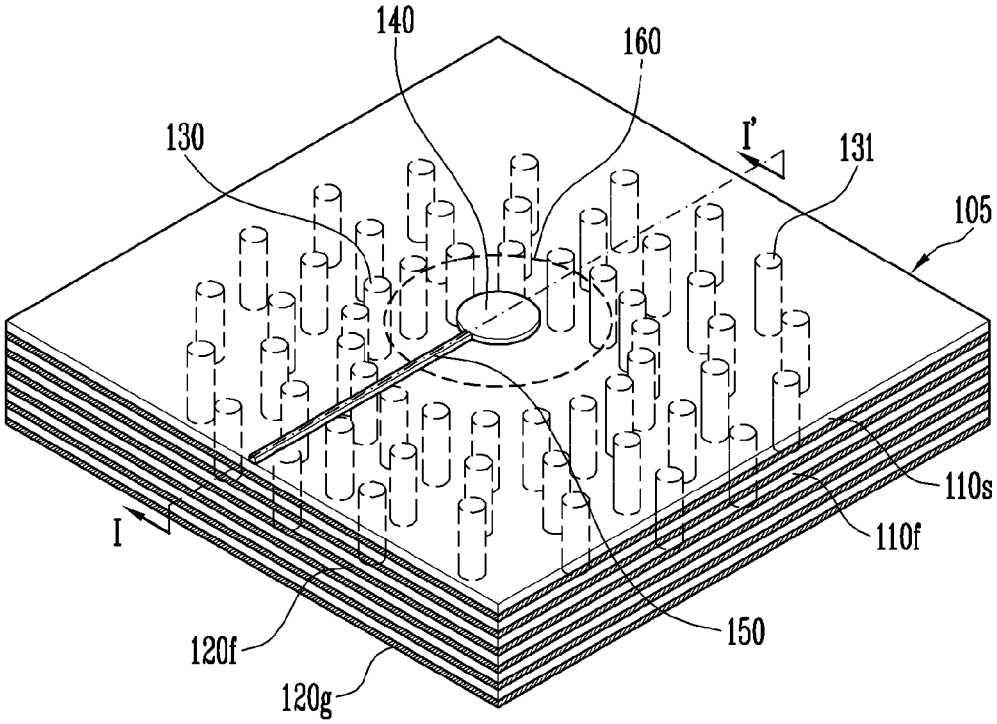
FIG. 1 is a perspective view of a patch antenna according to an embodiment of the present disclosure.

Throughout the drawings and the detailed description, unless otherwise described, the same drawing reference numerals will be understood to refer to the same elements, features, and structures. The relative size and depiction of these elements may be exaggerated for clarity, illustrating, and convenience.

DETAILED DESCRIPTION

Hereinafter, embodiments of the present disclosure will be explained in detail with reference to the drawings attached.

In describing the embodiments of the present disclosure, descriptions of techniques well known in the related art and descriptions of techniques not directly related to the embodiments of the present disclosure are omitted. This is for increased clarity and conciseness in presenting the gist of the present disclosure.

It should be understood that, when it is described that an configurative element is "connected" or "accessed" to another configurative element, the configurative element may be directly connected or directly accessed to the other configurative element or connected or accessed to the other configurative element through a third configurative element. Furthermore, it will be understood that the expression "comprising" is an open expression, merely indicating that those configurative elements exist, without excluding possible addition of other configurative elements.

Terminologies such as first or second may be used to describe various configurative elements but the configurative elements are not limited by the above terminologies. These terminologies are used to distinguish one configurative element from other configurative elements. For example, a first configurative element may be referred to as a second configurative element without departing from a scope in accordance with the concept of the present invention and similarly, a second configurative element may be referred to as a first configurative element.

Furthermore, the configurative units in the embodiments of the present disclosure are illustrated in order to represent different characteristic functions, and are not intended to mean that each of the configurative units consists of separate hardware or one software unit. That is, each of the configurative units is illustrated as such for convenience sake, but instead, at least two configurative units may form one configurative unit, or one configurative unit may be divided into a plurality of configurative units to perform functions. The integrated embodiment of each configurative unit and divided embodiments are included in the right of scope of the present disclosure as long as it is within the spirit of the present disclosure.

Furthermore, some of the configurative elements may be selective configurative elements for improving only the performance and may not be essential configurative elements for performing the essential functions in the present disclosure. The present disclosure may be embodied to include only the essential configurative units for realizing the essence of the present disclosure excluding the configurative elements used to improve only the performance, and the structure including only essential configurative elements excluding the selective configurative elements used for improving the performance may be included in the scope of right of the present disclosure.

In describing the embodiments of the present disclosure, when it is considered that detailed explanation on well known functions or configurations may obscure the gist of the embodiments of the present disclosure, detailed description thereof will be omitted. Hereinafter, the embodiments of the present disclosure will be explained with reference to the drawings attached. And the terms hereinafter are terms defined in consideration of the functions of the present disclosure that may have different meanings according to the intentions or practices of the user or operator. Therefore, the definitions should be made based on the entirety of the present disclosure.

A millimeter wave band system may be embodied in the system on package (SOP) format for miniaturization of product and for saving the costs. Examples of the system on package method include low temperature co-fired ceramics (LTCC) and liquid crystal polymer (LCP) technique, etc. Such a low temperature co-fired ceramics (LTCC) and liquid crystal polymer (LCP) technique are techniques where a multilayered substrate is used. Passive devices such as a capacitor, an inductor, and a filter etc. may be embedded inside the substrate, thereby miniaturizing the module and lowering the cost of the module.

Especially, in the configuration of a wireless system an antenna may be a core component that determines the performance of the system. Generally, in the case of fabricating a patch antenna that operates in the millimeter wave frequency, especially, in the ultra high frequency of about 60 GHz or more, signal leakage may occur in a surface wave form that flows along the surface of the dielectric substrate in the patch antenna. The thicker the substrate, and the greater the dielectric constant, the greater the signal leakage. Such leakage of signal deteriorates the radiation efficiency of the patch antenna and reduces the antenna gain. Furthermore, in a communication system of the 60 GHz, a broad bandwidth of 7 GHz or more is required, but it may be difficult to realize an antenna having such a broad bandwidth in a conventional patch antenna structure.

Meanwhile, in order to miniaturize the module. the system on package (SOP) technique such as the low temperature co-fired ceramics (LTCC) may be adopted to fabricate the module. However, since a ceramic substrate such as the low temperature co-fired ceramics has a higher dielectric constant than the organic substrate as aforementioned, when it is realized as a patch antenna, both the radiation efficiency and the gain of the antenna may decrease. Therefore, it is necessary to design a patch antenna structure that could restrict deterioration of the antenna characteristics caused by excitation of surface waves.

Figure 2:
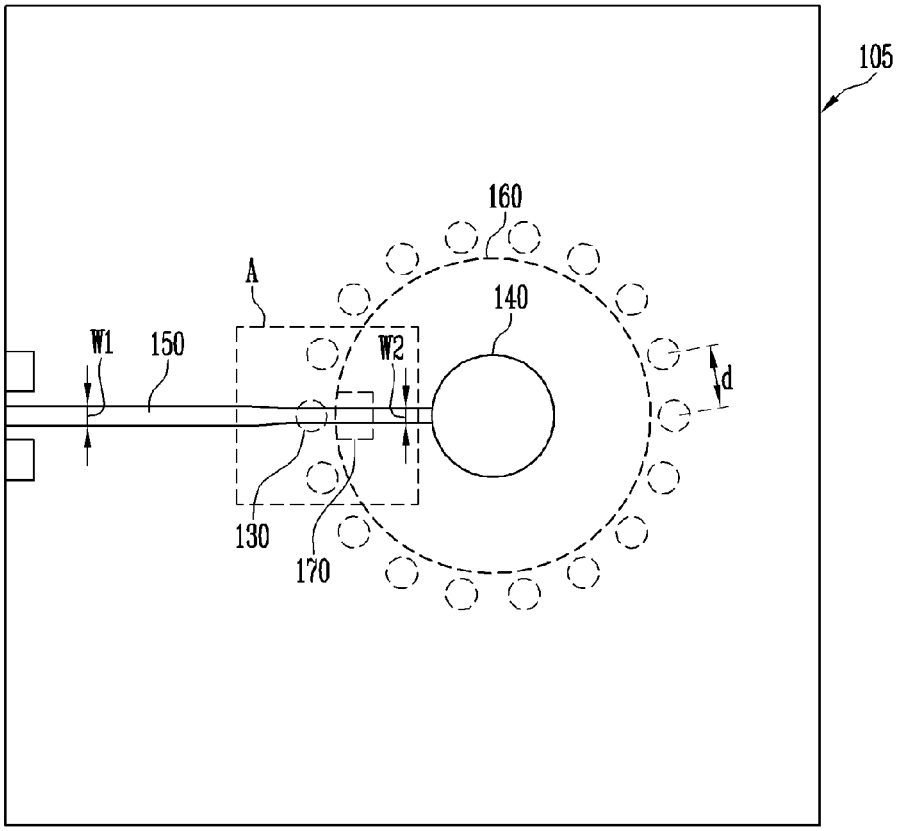
FIG. 2 is a top view of the patch antenna according to the embodiment of the present disclosure.
Figure 3:
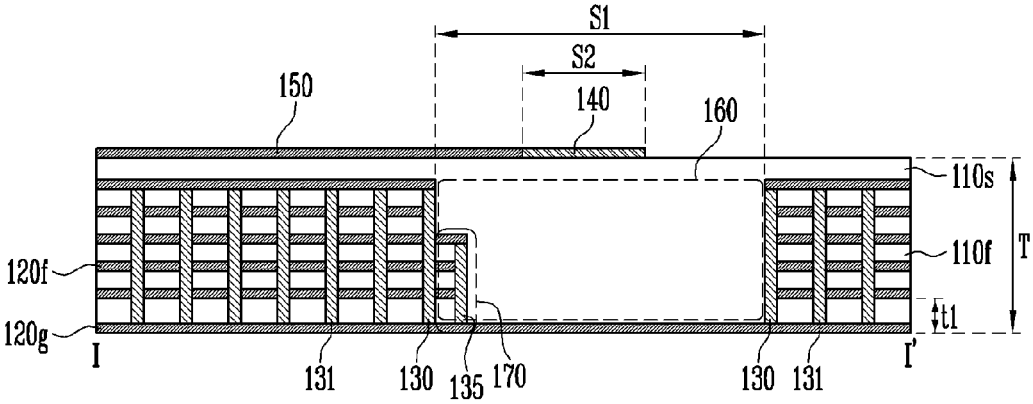
FIG. 3 is a cross-sectional view of FIG. 1 taken on line I-I'.
Figure 4A:
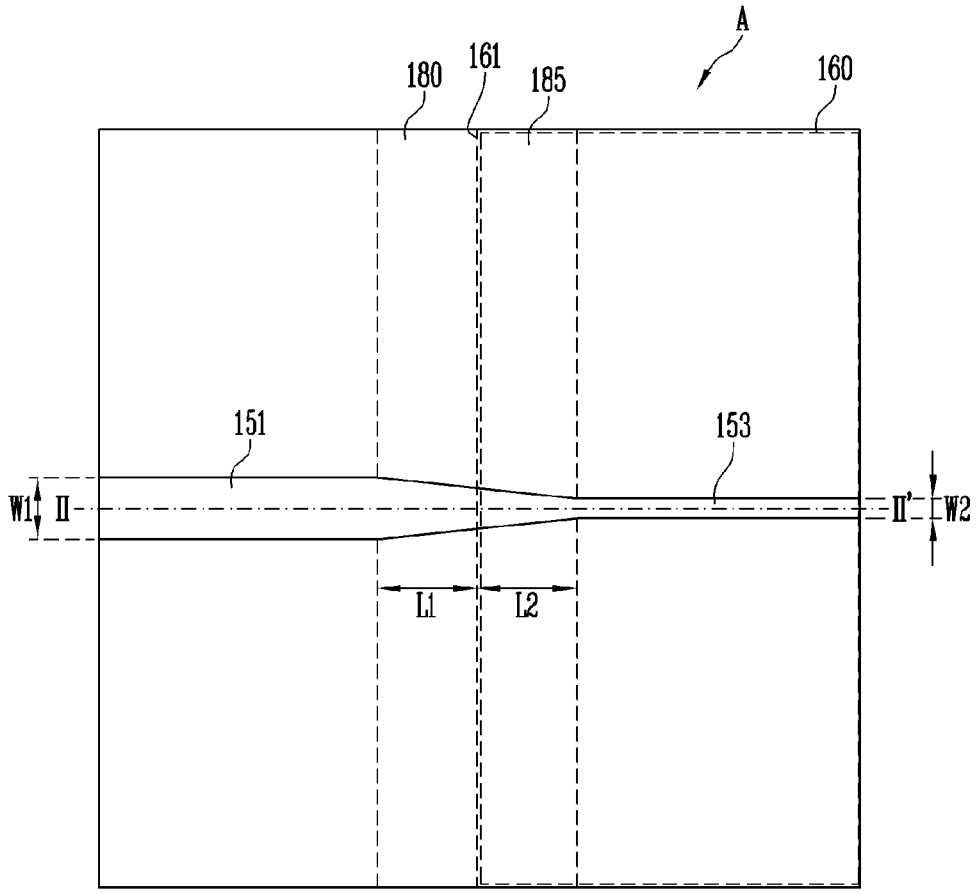
FIG. 4A is a top view of A area in FIG. 2.
Figure 4B:
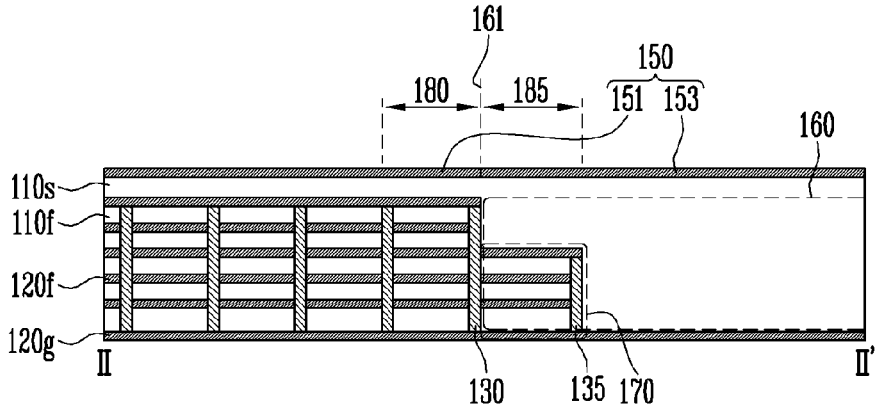
FIG. 4B is a cross-sectional view of FIG. 4A taken on line II-IF.

FIG. 1 is a perspective view of a patch antenna according to an embodiment of the present disclosure, FIG. 2 is a top view of the patch antenna according to the embodiment of the present disclosure, FIG. 3 is a cross-sectional view of FIG. 1 taken on line I-I', FIG. 4A is a top view of A area in FIG. 2, and FIG. 4B is a cross-sectional view of FIG. 4A taken on line II-IF.

Referring to FIGS. 1 to 4, the patch antenna according to an embodiment of the present disclosure may include a plurality of dielectric layers 110*f* and 110*s*, a multilayered substrate 105 that includes metal pattern layers 120*f* disposed between the plurality of dielectric layers 110*f* and 110*s*, an antenna patch 140 disposed on an upper surface of the multilayered substrate 105 and located in a central area 160, a ground layer 120*g* disposed on a lower surface facing the upper surface of the multilayered substrate 105, and a plurality of connection via patterns 130 that penetrate the inner dielectric layers 110*f* to electrically connect the metal pattern layers 120*f* and the ground layer 120*g* and that surround the central area 160. Furthermore, the patch antenna according to the embodiment of the present disclosure may further include a transmission line 150 for supplying signals to the antenna patch 140 on the upper surface of the multilayered substrate 105.

In this case, the central area 160 of the multilayered substrate 105 surrounded by the ground layer 120*g* and the plurality of connection via patterns 130 may serve as a dielectric resonator. That is, the patch antenna according to the embodiment of the present disclosure may include the antenna patch 140 located on the upper surface of the multilayered substrate 105, and a dielectric resonator formed in the central area 160 inside the multilayered substrate 105.

Meanwhile, in FIGS. 1 and 2, it is illustrated that the central area 160 has a circular shape, but there is no limitation thereto. That is, the central area 160 may have various shapes. For example, the shape of the central area 160 may be at least one of a circular shape, an octagonal shape, and a square shape, etc.

The multilayered substrate 105 may include the low temperature co-fired ceramics (LTCC). In this case, the multilayered substrate 105 may be formed by laminating the plurality of dielectric layers 110*f* and 110*s* having high dielectric constants, and then through a sintering process.

The metal pattern layers 120*f* may include a conductive metal. For example, the metal pattern layers 120*f* may include silver Ag, etc. Furthermore, except for the central area 160 of the multilayered substrate 105, the metal pattern layers 120*f* disposed between the plurality of dielectric layers 110*f* and 110*s* may be formed on one dielectric layer 110*f* in a printing method.

For example, the dielectric layers 110*f* and the metal pattern layers 120*f* may be laminated alternately. In this case, the dielectric layer located on an uppermost portion of the multilayered substrate 105 may be called a surface dielectric layer 110*s*.

That is, forming the multilayered substrate 105 including the metal pattern layer 120*f* may include printing each metal pattern layer 120*f* on each dielectric layer 110*f*, laminating these printed dielectric layers 110*f* together with the surface dielectric layer 110*s* having printed antenna patch 140.

Meanwhile, the antenna patch 140 may include a conductive metal. For example, the antenna patch 140 may be made of silver Ag. The antenna patch 140 may be formed on the surface dielectric layer 110*s* that constitutes the upper surface of the multilayered substrate 105 in a printing method. In this case, in FIGS. 1 and 2, it is illustrated that the antenna patch 140 has a circular shape, but there is no limitation thereto. That is, the antenna patch 140 may have various forms. For example, the shape of the antenna patch 140 may be at least one of a circular shape, a ring shape, an octagonal shape, a trapezoidal shape, a square shape, and a triangular shape, etc.

Furthermore, the ground layer 120*g* may include a conductive metal. For example, the ground layer 120*g* may be made of silver Ag. The ground layer 120*g* may be formed below the lowermost portion of the dielectric layer 110*f* in a printing method.

The plurality of connection via patterns 130 may include a conductive metal. For example, the plurality of connection via patterns 130 may be made of silver Ag. The plurality of connection via patterns 130 surrounding the central area 160 of the multilayered substrate 105 may be formed by forming via holes that penetrate the inner dielectric layers 110*f* and the metal pattern layers 120*f* and then filling the via holes with the conductive metal before laminating the surface dielectric layer 110*s* of the multilayered substrate 105. In this case, the forming of via holes may be done using a method such as punching, etc. This is because the dielectric layers 110*f* and 110*s* have flexibility before they are sintered. The patch antenna may be fabricated by forming the connection via patterns 130 on each dielectric layer, and printing metal patterns including inner ground patterns 120*f* and bottom ground pattern 120*g* antenna patch 140, and then laminating all layers, and then sintering the result. Accordingly, the connection via patterns 130 may be configured such that they extend from the ground layer 120*g* up to the lower portion of the surface dielectric layer 110*s*. Furthermore, in some embodiments, the connection via patterns 130 may be configured to extend up to the metal pattern layer 120*f* that is just below the surface dielectric layer 110*s*.

Furthermore, the plurality of connection via patterns 130 formed to surround the central area 160 of the multilayered substrate 105 may be spaced apart from each other by a distance d of or less than half ($\lambda/2$) a wavelength ($\lambda$) of a signal being radiated from the antenna patch 140. Therefore, the plurality of connection via patterns 130 formed to surround the central area 160 of the multilayered substrate 105 may act as a metallic fence, and the central area 160 of the multilayered substrate 105 may act as a resonator.

In some embodiments of the present disclosure, besides the plurality of connection via patterns 130 that surround the central area 160 of the multilayered substrate 105, additional via patterns 131 arranged radially around the central area 160 may be further included inside the multilayered substrate 105. This is to minimize the signals radiated from the antenna patch 140 from escaping out of the central area 160. Meanwhile, in FIG. 2, illustration of the additional via patterns 131 is omitted.

Meanwhile, by the coupling between the antenna patch 140 and the central area 160, the bandwidth of the patch antenna may be increased. Accordingly, in order to realize a patch antenna having broadband characteristics, it is possible to adjust such that the antenna patch 140 and the central area 160 have an appropriate coupling value.

In the patch antenna according to an embodiment of the present disclosure, the antenna patch 140 is far away from the ground layer 120*g*, and thus, the impedance of the antenna patch 140 may have a value appropriate for radiation.

Furthermore, in areas outside the central area 160 of the multilayered substrate 105, the ground layer 120*g* is located inside the multilayered substrate 105 through the connection via patterns 130, and thus, the distance between the surface dielectric layer 110*s* and the ground layer 120*g* of the multilayered substrate 105 may be close to each other. That is, as the metal pattern layers 120*f* and the ground layer 120*g* are electrically connected by the plurality of connection via patterns 130, the surface dielectric layer 110*s* and the ground layer 120*g* of the multilayered substrate 105 may be disposed close to each other. Accordingly, the signal leakage in the surface wave form from the antenna patch 140 may be restricted.

More specifically, in general, the farther away the transmission line 150 is from the ground layer 120*g*, that is, the thicker the multilayered substrate 105, the more easily the surface wave may be transmitted. Therefore, in the patch antenna according to an embodiment of the present disclosure, in areas besides the antenna patch 140, the ground layer 120*g* may be disposed close to the transmission line 150, thereby restricting transmission of the surface wave. Therefore, signals being leaked from the antenna patch 140 in the surface wave form may not be leaked towards outside, but may be accumulated in the central area 160 instead, that is, in the dielectric resonator. In this case, if the size of the central area 160 is adjusted to resonate in the designed frequency band of the patch antenna, the resonated signal will be radiated towards outside the multilayered substrate 105, thereby increasing the radiation efficiency and antenna gain of the patch antenna.

Furthermore, by the coupling between the antenna patch 140 and the central area 160, the bandwidth of the antenna may be increased. That is, it is possible to adjust the coupling value of the dielectric resonator and the antenna patch 140 being formed in the central area 160 of the multilayered substrate 105 so that the bandwidth of the patch antenna is expanded and the patch antenna having broadband characteristics is realized.

In this case, if the antenna does not include the impedance transformer 170, the antenna band having a reflection loss of 10 dB or more may be between about 57 and 64.3 GHz, that is, a bandwidth of about 7.3 GHz. Furthermore, the patch antenna that does not include the impedance transformer 170 may have high-gain characteristics of 8.4 dBi.

However, countries may have different frequencies allocated to the 60 GHz communication system. For example, in the case of USA and Canada, the frequency allocated to the 60 GHz communication system is 57.5 to 64 GHz, in the case of Australia, 59.4 to 62.9 GHz, in the case of China, 59 to 64 GHz, and in the case of the Republic of Korea, 57 to 64 GHz. Furthermore, in the case of Japan, the frequency allocated to the 60 GHz communication system is 59 to 66 GHz, and in the case of Europe, 57 to 66 GHz.

Herein, in the case of the patch antenna in which the impedance transformer 170 is not included, according to the aforementioned example, the frequency band is about 57 to 64.6 GHz, satisfying the frequency band of the Republic of Korea, USA, China, and Australia, but not that of Europe and Japan. Therefore, in order to satisfy the entire bands of frequency allocated to the 60 GHz communication system, an antenna satisfying the bandwidth of about 9 GHz of band of about 57 to 66 GHz is necessary.

Furthermore, referring to FIG. 4A and FIG. 4B, the transmission line 150 may have a form where a first transmission line unit 151 and a second transmission line unit 153 are combined. The first transmission line unit 151 may be disposed on the upper surface of the multilayered substrate 105 and outside the central area 160, and may receive signals from outside the patch antenna. Furthermore, the second transmission line unit 153 may be disposed on the upper surface of the multilayered substrate 105 and within the central area 160, and may be connected to the antenna patch 140 and supply the signals being transmitted from the first transmission line unit 151 to the antenna patch 140.

In this case, a width W1 of the first transmission line unit 151 and a width W2 of the second transmission line unit 153 may be different from each other. Furthermore, in some embodiments of the present disclosure, the width W1 of the first transmission line 151 may be greater than the width W2 of the second transmission line unit 153. For example, the width W1 of the first transmission line unit 151 may be about 140 um and its distance from the ground layer 120*g* may be about 100 um, having an impedance of about 50 ohm, while the width W2 of the second transmission line unit 153 may be about 80 um and its distance from the ground layer 120*g* may be about 600 um, having an impedance of about 90 to 92 ohm.

Due to the width W1 of the first transmission line unit 151 of the transmission line 150 and the width W2 of the second transmission line 153 of the transmission line 150 being different from each other, and due to the distance between the first transmission line unit 151 and the ground layer 120*g* and the distance between the second transmission line unit 153 and the ground layer 120*g* being different from each other, an impedance difference may occur in the connecting portion between the first transmission line unit 151 and the second transmission line unit 153. In this case, due to the impedance difference that occurs in the connecting portion between the first transmission line unit 151 and the second transmission line 153, a reflection of signal may occur, thereby significantly reducing the bandwidth of the antenna.

Accordingly, in order to alleviate the reflection of signal due to rapid changes in the impedance between the first transmission line unit 151 and the second transmission line unit 153 near the central area 160 of the multilayered substrate 105, the patch antenna according to the embodiment of the present disclosure may include the impedance transformer 170.

The impedance transformer 170 may be located below the second transmission line unit 153 within the central area 160 of the multilayered substrate 105. Furthermore, in some embodiments, the impedance transformer 170 may be located below the second transmission line unit 153 within the second area 184 of the central area 160. The second area 185 may be an area expanded inwardly by as much as a second predetermined length L2 from a boundary line 161 of the central area 160.

Furthermore, the impedance transformer 170 may include an impedance transformation pattern 135. In this case, the impedance transformation pattern 135 may have a lower height than the connection via patterns 130 included in the multilayered substrate 105. Furthermore, the impedance transformation pattern 135 may extend towards the surface dielectric layer 110*s* from the ground layer 120*g*. Therefore, in some embodiments, the impedance transformation pattern 135 may extend up to a middle layer of the plurality of dielectric layers 110*f* and 110*s* laminated on the multilayered substrate 105. For example, in the case where the multilayered substrate 105 is a configuration on which six(6) dielectric layers 110*f* and 110*s* are laminated, the impedance transformation pattern 135 may extend from the ground layer 120*g* up to three(3) dielectric layers 110*f*.

Meanwhile, the metal pattern layers 120*f* may extend up to the impedance transformation pattern 135. For example, in the case where the impedance transformation pattern 135 extends from the ground layer 120*g* up to three(3) dielectric layers 110*f*, three(3) metal pattern layers 120*f* may be connected to the impedance transformation pattern 135 from the ground layer 120*g* in the direction of the transmission line 150.

As aforementioned, the impedance transformer 170 may place the ground layer 120*g* within the central area 160 to be close to the transmission line 150 using the impedance transformation pattern 135. Accordingly, the impedance of the second transmission line unit 153 in the second area 185 where the impedance transformer 170 is formed may be greater than the impedance of the first transmission line unit 151 outside the first area 180 and smaller than the impedance of the second transmission line unit 153 outside the second area 185.

Furthermore, the impedance of the transmission line 150 in the second area 185 where the impedance transformer 170 is formed may have a middle value of the impedance of the first transmission line unit 151 and the impedance of the second transmission line unit 153. For example, in the case where the multilayered substrate 105 has six(6) dielectric layers 110*f* and 110*s* laminated thereon, and the impedance transformation pattern 135 extends from the ground layer 120*g* up to three(3) dielectric layers 110*f*, the impedance of the transmission line 150 in the second area 185 where the impedance transformer 170 is formed may have a middle value of the impedance of the first transmission line 151 and the impedance of the second transmission line unit 153.

Meanwhile, the width W1 of the first transmission line unit 151 and the width W2 of the second transmission line unit 152 may be different from aforementioned. Therefore, the first transmission line unit 151 and the second transmission line unit 153 may be connected to each other in a trapezoid form such that there is no discontinuous point of connection as illustrated in FIG. 4.

In this case, based on an assumption that the area expanded outwardly from the boundary line 161 of the central area 160 by as much as the first predetermined length L1 is the first area 180, the width of the first transmission line unit 151 may decrease as it gets closer to the boundary line 161 of the central area 160 within the first area 180. Furthermore, the width of the second transmission line unit 153 may increase as it gets closer to the boundary line 161 of the central area 160 within the second area 185. Furthermore, the width of the first transmission line unit 151 that decreased towards the boundary line 161 in the first area 180 may be identical to the width of the second transmission line unit 153 that increased towards the boundary line 161 of the central area 160 in the second area 185 at the boundary line 161 of the central area 160. In this case, the first length L1 of the first area 180 and the second length L2 of the second area 185 may be identical to each other.

Meanwhile, in some embodiments, the dielectric constant of each of the dielectric layers 110*f* and 110*s* may be about 5.8. Furthermore, the thickness t1 of each of the dielectric layers 110*f* and 110*s* may be about 0.1 mm. Otherwise, in some embodiments, the thickness of one dielectric layer 110*f* and 100*s* and one metal pattern layer 120*f* combined may be about 0.1 mm. Furthermore, the thickness T of the multilayered substrate 105 where six(6) dielectric layers 110*f* and 110*s* are laminated may be about 0.6 mm. Furthermore, the antenna patch 140 may have a diameter S2 of about 1.65 mm such that it may resonate at the 60 GHz. Furthermore, the diameter S1 of the central area 160 of the multilayered substrate 105 that serves as the dielectric resonator may be 3.5 mm. Furthermore, the width W1 of the first transmission line unit 151 outside the first area 180 may be about 140 um, having an impedance of about 50 ohm, and the width W2 of the second transmission line outside the second area 185 may be about 80 um, having an impedance of about 90 to 92 ohm.

The patch antenna according to an embodiment of the present disclosure includes an impedance transformer 170 located below the second transmission line unit 153 within the central area 160, and may thus alleviate the rapid changes in the impedance that occur due to the width W1 of the first transmission line unit 151 and the width W2 of the second transmission line unit 153 being different from each other.

Figure 5:
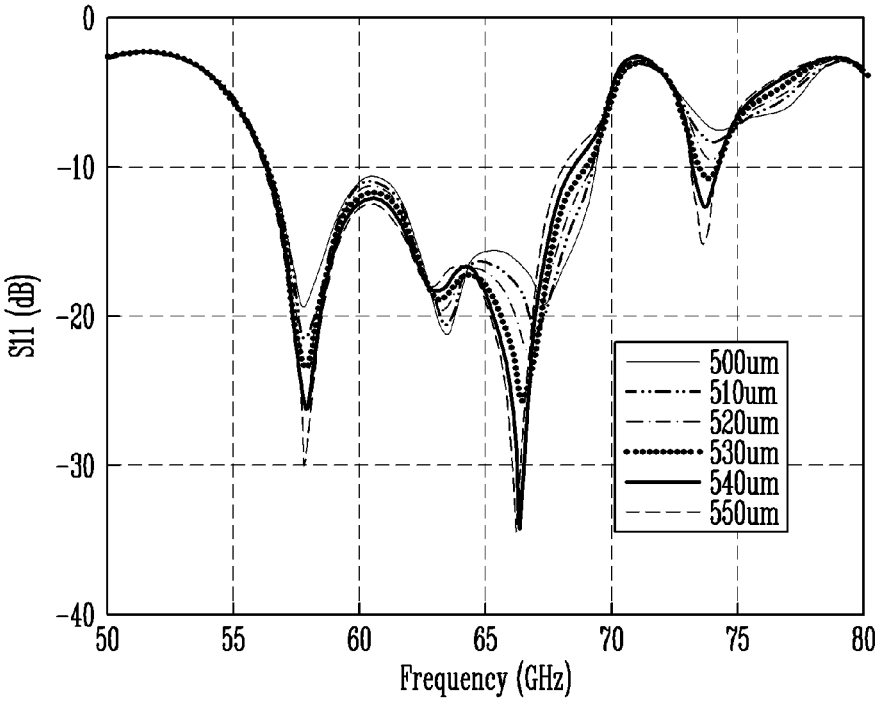
FIG. 5 is a view illustrating reflection characteristics of the patch antenna by changes in a first length and a second length.
Figure 6:
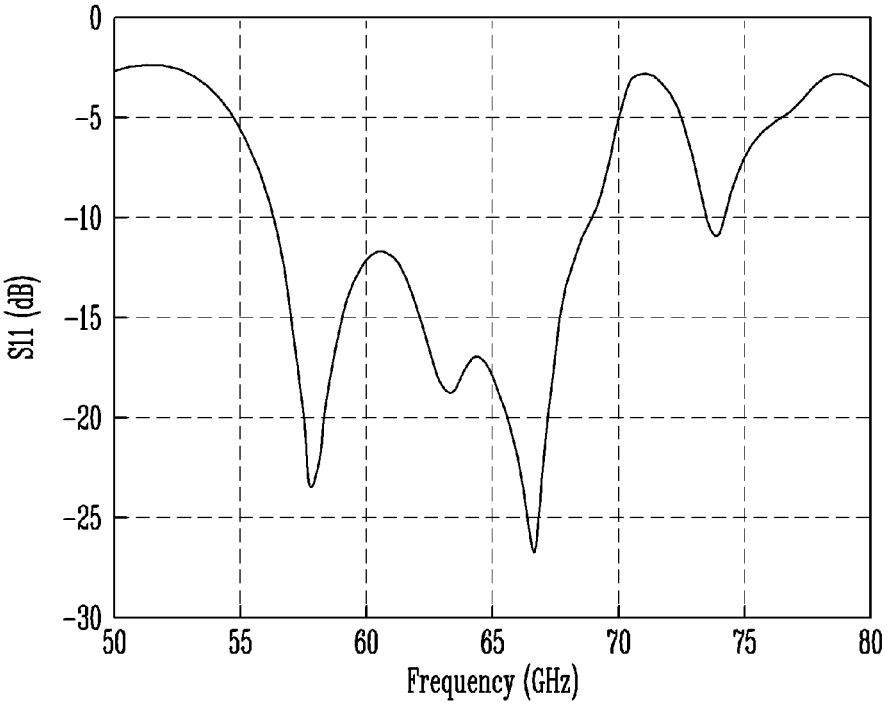
FIG. 6 is a view illustrating reflection characteristics of the patch antenna in the case where each of the first length and the second length is 540 um.
Figure 7:
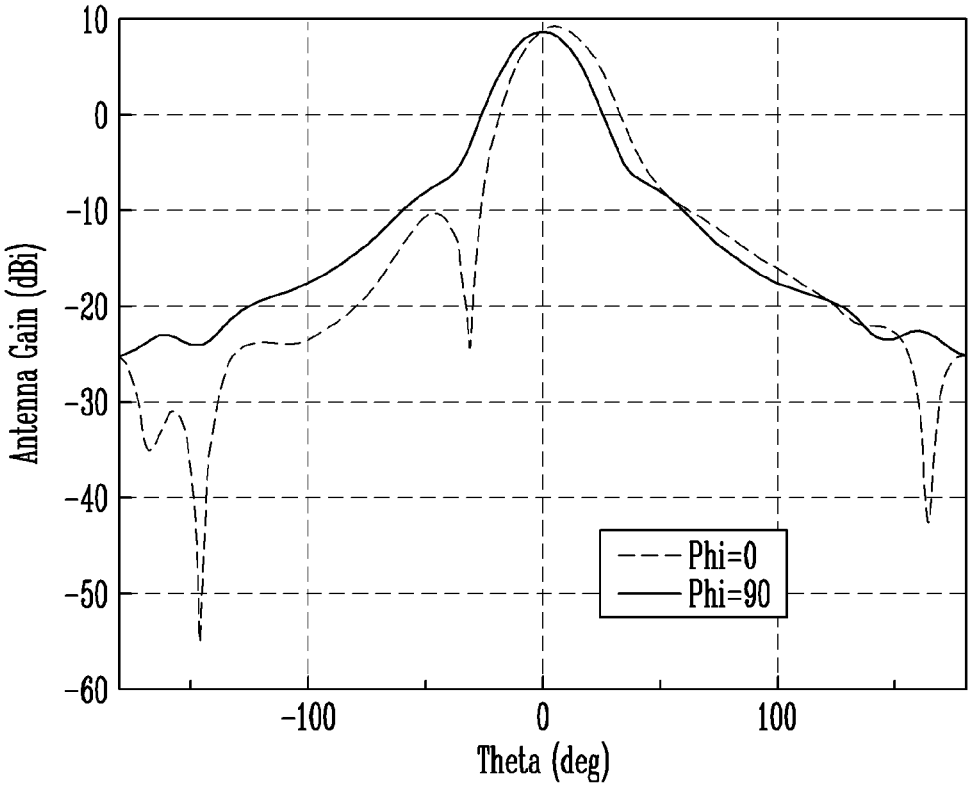
FIG. 7 is a view illustrating radiation characteristics of the patch antenna according to the embodiment of the present disclosure.

FIG. 5 is a view illustrating reflection characteristics of a patch antenna by changes of the first length and the second length, FIG. 6 is a view illustrating reflection characteristics of the patch antenna in the case where each of the first length and the second length is 540 um, and FIG. 7 is a view illustrating radiation characteristics of the patch antenna according to an embodiment of the present disclosure.

As explained hereinabove with reference to FIGS. 1 to 4, in the case of the patch antenna according to an embodiment of the present disclosure, the first transmission line unit 151 and the second transmission line unit 153 may be connected in a trapezoidal form such that there is no discontinuous point of connection between the first transmission line unit 151 and the second transmission line unit 153. In this case, the width of the first transmission line unit 151 may decrease as it gets closer to the boundary line 161 of the central area 160 in the first area 180, and the width of the second transmission line unit 153 may increase as it gets closer to the boundary line 161 of the central area 160 in the second area 185.

In this case, the reflection characteristics of the patch antenna may vary depending on the first length L1 of the first area 180 and the second length L2 of the second area 185. Hereinafter, for convenience of explanation, description will be made based on an assumption that the first length L1 and the second length L2 are a same length L.

FIG. 5 illustrates result of electromagnetic field simulation experiments carried out by using a high frequency simulation software (HFSS) so as to look into the reflection characteristics of a patch antenna (refer to the patch antenna 105 illustrated in FIG. 1) with various length L illustrated in FIG. 4.

In this case, when the length L of each of the first area 180 and the second area 185 is 500 um, 510 um, 520 um, 530 um, 540 um, or 550 um. The band of the antenna having a reflection loss of 10 dB or more may be about 56 to 66 GHz. Therefore, the length L of each of the first area 180 and the second area 185 may be 500 um to 550 um.

In this case, the reflection characteristics of the antenna may vary depending on the length L of the first area 180 and the second area 185. Referring to FIG. 5, it can be seen that the bandwidth of the antenna having a reflection loss of 10 dB or more becomes broader as the length L of the first area 180 and the second area 185 becomes shorter. For example, it can be seen that the antenna bandwidth of when the length L of the first area 180 and the second area 185 is 500 um is broader than the antenna bandwidth of when the length L of the first area 180 and the second area 185 is 550 um.

However, it can be seen that the reflection loss of the patch antenna at the 60 GHz area becomes closer to 10 dB as the length L of each of the first area 180 and the second area 185 becomes shorter. For example, it can be seen that in the 60 GHz area, the reflection loss of when the length L of each of the first area 180 and the second area 185 is 500 um is smaller than the reflection loss of when the length L of each of the first area 180 and the second area 185 is 550 um.

In such a case where the length L of each of the first area 180 and the second area 185 is, for example, 500 um, the characteristics of the antenna may change due to fabrication errors during manufacturing processes and the like of the patch antenna, and the reflection loss may therefore become smaller than 10 dB at the 60 GHz band. In the case where the reflection loss of the antenna becomes smaller than 10 dB at the 60 GHz band, the 60 GHz band will no longer be included in the band of the patch antenna, thereby causing problems of the patch antenna of not being able to operate normally. This problem may also occur when the length L of each of the first area 180 and the second area 185 is 510 um to 530 um.

Therefore, even when the antenna characteristics change due to the fabrication errors during manufacturing process and the like of the patch antenna together with the bandwidth of the patch antenna, considering the length L of each of the first area 180 and the second area 185 such that the reflection loss at the 60 GHz does not fall below 10 dB, the length L of each of the first area 180 and the second area 185 may be about 540 um.

Referring to FIG. 6, the antenna band having a reflection loss of 10 dB or below may be about 56.4 to 68.4 GHz when the length L of each of the first area 180 and the second area 185 is about 540 um. Furthermore, it is highly likely that the reflection loss at the 60 GHz band less than 10 dB, and therefore even when the antenna characteristics change due to problems such as the fabrication errors during manufacturing process and the like of the patch antenna, the reflection loss at the 60 GHz does not fall below 10 dB.

In such a case where the length L of each of the first area 180 and the second area 185 is about 540 um, the bandwidth of the patch antenna may have the broadband characteristics of about 12 GHz. When the antenna band of the patch antenna is about 56.4 to 68.4 GHz, all the band areas of 57 to 66 GHz allocated to communication of the 60 GHz band worldwide may be satisfied.

FIG. 7 illustrates radiation characteristics at the 60 GHz band of the patch antenna according to an embodiment of the present disclosure. In FIG. 7, axis x represents the theta with respect to the direction that is vertical to the multilayered substrate 105, while axis y represents the antenna gain.

In this case, it can be seen that the patch antenna may have up to 9.04 dBi of high-gain characteristics. Furthermore, it can be seen that the gains in the vertical direction (Phi=90) to the transmission line 150 and the horizontal direction (Phi=0) to the transmission line 150 are very similar to each other. This is because leakage of signal in the surface wave form is being restricted from flowing along the surface of the multilayered substrate 105.

The embodiments disclosed in the present specification and the drawings attached hereto are presented only to help understand the present disclosure more easily, and not to limit the scope of the present disclosure. It will be apparent to one skilled in the art that other modified examples that are based on the technical concept of the present disclosure can be implemented as well besides those disclosed herein.

Meanwhile, although the present specification and the drawings disclose preferable embodiments of the present disclosure, and use certain terms, this is to help understand the present disclosure more easily, and not to limit the scope of the present disclosure. It will be apparent to one skilled in the art that other modified examples that are based on the technical concept of the present disclosure can be implemented as well besides those disclosed herein.

What is claimed is:

1. A patch antenna comprising:

a multilayered substrate on which a plurality of dielectric layers are laminated;

at least one metal pattern layer disposed between the plurality of dielectric layers outside a central area of the multilayered substrate;

an antenna patch disposed on an upper surface of the multilayered substrate and within the central area;

a ground layer disposed on a lower surface of the multilayered substrate;

a plurality of connection via patterns penetrating the plurality of dielectric layers to connect the metal pattern layer and the ground layer, and surrounding the central area;

a transmission line comprising a first transmission line unit disposed on the upper surface of the multilayered substrate and located outside the central area, and a second transmission line unit disposed on the upper surface of the multilayered substrate and located within the central area; and an impedance transformer located below the second transmission line unit within the central area of the multilayered substrate.

2. The patch antenna according to claim 1, wherein the impedance transformer is located below the second transmission line unit within a second area expanded inwardly by as much as a second predetermined length from a boundary line of the central area.

3. The patch antenna according to claim 1, wherein the impedance transformer comprises at least one impedance conversion pattern that has a lower height than the connection via patterns, and that extends from the ground layer towards the upper surface of the multilayered substrate.

4. The patch antenna according to claim 3, wherein the impedance transformation pattern extends up to a middle layer of the plurality of dielectric layers laminated on the multilayered substrate.

5. The patch antenna according to claim 3, wherein the at least one metal pattern layer extends up to the impedance transformation pattern.

6. The patch antenna according to claim 1, wherein the first transmission line unit and the second transmission line unit are connected in a trapezoidal form.

7. The patch antenna according to claim 1, wherein, within a first area expanded outwardly by as much as a first predetermined length from a boundary line of the central area, a width of the first transmission line unit decreases as it becomes closer to the boundary line of the central area, and within a second area expanded inwardly by as much as a second predetermined length from the boundary line of the central area, a width of the second transmission line unit increases as it becomes closer to the boundary line of the central area.

8. The patch antenna according to claim 7, wherein the first length and the second length are identical to each other.

9. The patch antenna according to claim 7, wherein the width of the first transmission line unit outside the first area is 140 um, the width of the second transmission line unit outside the second area is 80 um, and each of the first length and the second length is 500 um to 550 um.

10. The patch antenna according to claim 7, wherein the width of the first transmission line unit outside the first area is 140 um, the width of the second transmission line unit outside the second area is 80 um, and each of the first length and the second length is 540 um.

11. The patch antenna according to claim 1, wherein the width of the first transmission line unit and the width of the second transmission line unit are different from each other.

12. The patch antenna according to claim 1, wherein the plurality of connection via patterns are spaced apart from each other by or less than a half a wavelength being radiated from the antenna patch.

13. The patch antenna according to claim 1, wherein a shape of the antenna patch is at least one of a ring shape, a circular shape, an octagonal shape, a trapezoidal shape, a square shape, and a triangular shape.

14. The patch antenna according to claim 1, wherein a shape of the central area is at least one of a circular shape, an octagonal shape, and a square shape.

* * * * *